US008204423B2

(12) United States Patent
Hatori et al.

(10) Patent No.: US 8,204,423 B2
(45) Date of Patent: Jun. 19, 2012

(54) CLEANING DEVICE WITH ACCUMULATION PREVENTION, PROCESS CARTRIDGE, AND IMAGE FORMING APPARATUS INCLUDING SAME

(75) Inventors: Satoshi Hatori, Yokohama (JP); Takaya Muraishi, Kawasaki (JP); Takeshi Shintani, Kawasaki (JP); Yasushi Akiba, Yokohama (JP); Akio Kosuge, Yokohama (JP); Kaoru Yoshino, Tokyo (JP); Hiroyuki Nagashima, Yokohama (JP); Fumihito Itoh, Kawasaki (JP); Hiroshi Ono, Tokyo (JP); Nobuo Kuwabara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 706 days.

(21) Appl. No.: 12/350,622

(22) Filed: Jan. 8, 2009

(65) Prior Publication Data

US 2009/0185842 A1 Jul. 23, 2009

(30) Foreign Application Priority Data

Jan. 21, 2008 (JP) ..... 2008-010785

(51) Int. Cl.
*G03G 21/00* (2006.01)

(52) U.S. Cl. ..... 399/346; 399/351

(58) Field of Classification Search ..... 399/346, 399/351

See application file for complete search history.

(56) References Cited

U.S. PATENT DOCUMENTS

| | | | | |
|---|---|---|---|---|
| 7,313,347 | B2 | 12/2007 | Shintani et al. | |
| 7,366,441 | B2 | 4/2008 | Hatori et al. | |
| 7,536,147 | B2 | 5/2009 | Kageyama | |
| 2001/0022910 | A1 | 9/2001 | Sawayama | |
| 2004/0072093 | A1 | 4/2004 | Itami | |
| 2004/0109711 | A1 | 6/2004 | Kanagawa | |
| 2005/0152722 | A1 | 7/2005 | Tawanda et al. | |
| 2006/0045603 | A1 | 3/2006 | Hatori et al. | |
| 2007/0059035 | A1 | 3/2007 | Yoshino et al. | |
| 2008/0069614 | A1 | 3/2008 | Shintani et al. | |
| 2008/0069615 | A1 | 3/2008 | Shintani et al. | |
| 2008/0089726 | A1 * | 4/2008 | Hatakeyama et al. | 399/346 |
| 2010/0021205 | A1 * | 1/2010 | Honjoh et al. | 399/346 |

FOREIGN PATENT DOCUMENTS

| | | | |
|---|---|---|---|
| CN | 1584750 | A | 2/2005 |
| CN | 1983076 | A | 6/2007 |
| EP | 1 521 138 | A | 4/2005 |
| JP | 10-260614 | | 9/1998 |
| JP | 2001-235987 | | 8/2001 |
| JP | 2006-258989 | A | 9/2006 |
| JP | 2007-304301 | | 11/2007 |
| JP | 2007292920 | A * | 11/2007 |
| JP | 2008-008925 | | 1/2008 |
| JP | 2008-076426 | | 4/2008 |

* cited by examiner

*Primary Examiner* — David Gray
*Assistant Examiner* — Laura Roth
(74) *Attorney, Agent, or Firm* — Dickstein Shapiro LLP

(57) ABSTRACT

Described embodiments include apparatuses and processes for cleaning a surface of a rotatable image carrier including a cleaning unit configured to prevent material from accumulating on a cleaning blade.

3 Claims, 10 Drawing Sheets

CLEANING DEVICE WITH ACCUMULATION PREVENTION, PROCESS CARTRIDGE, AND IMAGE FORMING APPARATUS INCLUDING SAME

CROSS-REFERENCE TO RELATED APPLICATIONS

This patent specification claims priority from Japanese Patent Application No. 2008-010785, filed on Jan. 21, 2008 in the Japan Patent Office, the entire contents of which are hereby incorporated by reference herein.

BACKGROUND OF THE INVENTION

1. Field of the Invention

The present invention generally relates to an image forming apparatus, such as a copier, a printer, a facsimile machine, a multifunction machine including at least two of those functions, etc., a cleaning device used therein, and a process cartridge.

2. Discussion of the Background Art

In general, an electrophotographic image forming apparatus, such as a copier, a printer, a facsimile machine, a multifunction machine including at least two of those functions, etc., includes an image forming unit for forming an electrostatic latent image on an image carrier, and developing the latent image with developer. The developed image (toner image) is then transferred from the image carrier onto a sheet of recording medium, such as paper, overhead projector (OHP) films, and the like, and fixed thereon.

After the image is transferred from the image carrier, a cleaning device including a cleaning blade, or the like, removes any toner remaining on a surface of the image carrier.

A known cleaning device for the image carrier includes a lubricant applicator that applies lubricant onto the surface of the image carrier while a cleaning blade removes any toner remaining on the image carrier after the image is transferred therefrom. Applying lubricant onto the surface of the image carrier can decrease a frictional coefficient of the surface of the image carrier, enhancing removability of the toner while preventing or reducing filming of the image carrier, which means that the toner or the like adheres firmly to the surface of the image carrier. Moreover, when a photoreceptor is used as the image carrier, such an arrangement can reduce scraping of the photoreceptor.

FIG. 1 schematically illustrates an example of one such known image forming unit.

As shown in FIG. 1, the image forming unit includes a photoreceptor 3Z that rotates in a direction indicated by an arrow in FIG. 1 (hereinafter "photoreceptor rotational direction"), a cleaning device 6Z located on the right of the image carrier 3Z, and a developing unit 5Z located on the left of the image carrier 3Z in FIG. 1. The cleaning device 6Z includes a cleaning blade 61Z, a roller-shaped lubricating brush 62Z located downstream from the cleaning blade 61Z, and a doctor blade 66Z located downstream from the lubricating brush 62Z in the photoreceptor rotational direction and contacting the photoreceptor 3Z.

The lubricating brush 62Z scrapes a solid lubricator 64Z and applies the scraped lubricant onto a surface of the photoreceptor 3Z while rotating. Then, the doctor blade 66Z distributes the lubricant on the surface of the photoreceptor 3Z evenly so as to form a uniform lubricant layer thereon. When the lubricant on the surface of the photoreceptor 3Z is excessive, the doctor blade 66Z removes and retains the excessive lubricant.

In the cleaning device 6Z described above, although the cleaning blade 61Z scrapes off the toner remaining on the surface of the photoreceptor 3Z, a small amount of the scraped toner can slip through a gap between the cleaning blade 61Z and the photoreceptor 3Z and reach the lubricating brush 62Z or the doctor blade 66Z. Such toner is then scraped or retained by the lubricating brush 62Z or the doctor blade 66Z.

In the configuration in which the lubricating brush 62Z is located above the cleaning blade 61Z, the toner removed or retained by the lubricating brush 62Z can drop therefrom onto the cleaning blade 61Z. Additionally, it can happen that some of the lubricant scraped from the solid lubricant 64Z fails to be applied to the photoreceptor 3Z but remains on the lubricating brush 62Z (hereinafter "unused lubricant"), and such unused lubricant can drop onto the cleaning blade 61Z as well.

SUMMARY OF THE INVENTION

In view of the foregoing, in one illustrative embodiment of the present invention, a cleaning device for cleaning a surface of a rotatable image carrier includes a cleaning blade disposed to contact the image carrier and configured to remove toner on the surface of the image carrier, a lubricant applicator unit disposed above the cleaning blade, downstream from the cleaning blade in a surface rotation direction of the image carrier and configured to apply lubricant onto the surface of the image carrier, and an accumulation preventer configured to prevent the toner and excessive lubricant from the lubricant applicator unit from accumulating on the cleaning blade.

In another illustrative embodiment of the present invention, a process cartridge is configured to be removably insertable into an image forming apparatus and accommodate a rotatable image carrier and the cleaning device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
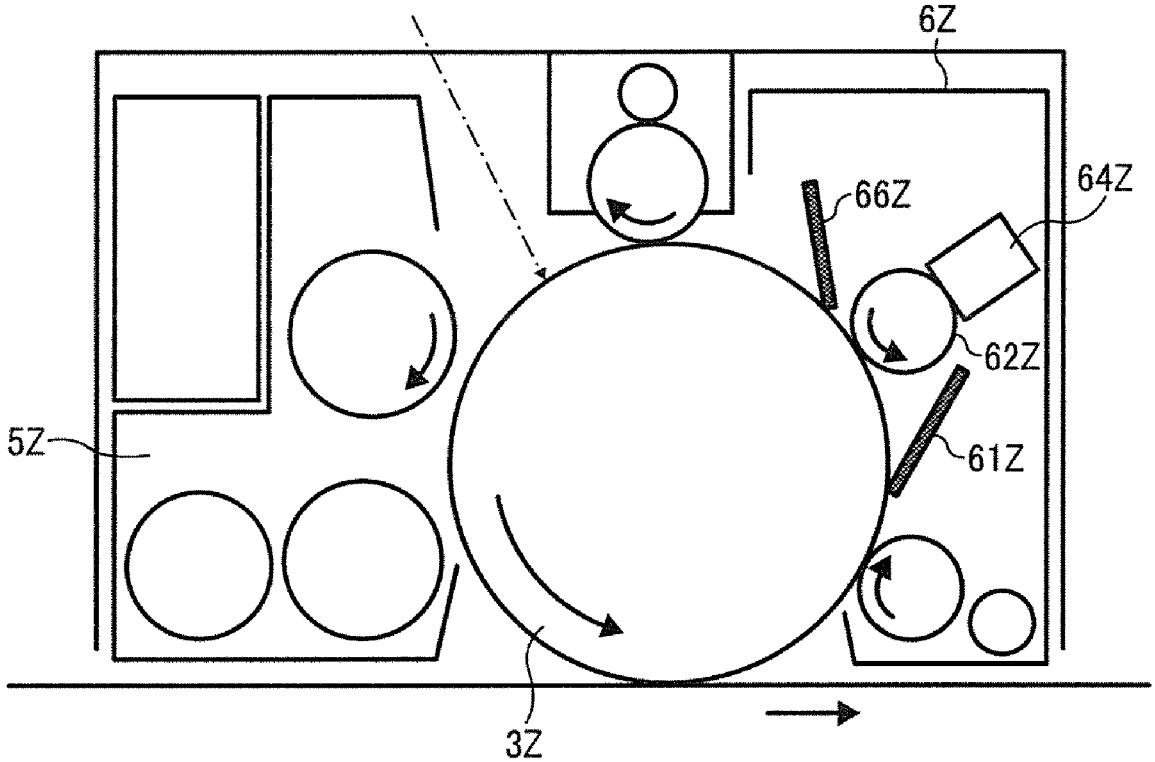
FIG. 1 RELATED ART
FIG. 1 is an end-on cross-sectional view schematically illustrating an example of a known image forming unit including a cleaning device.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
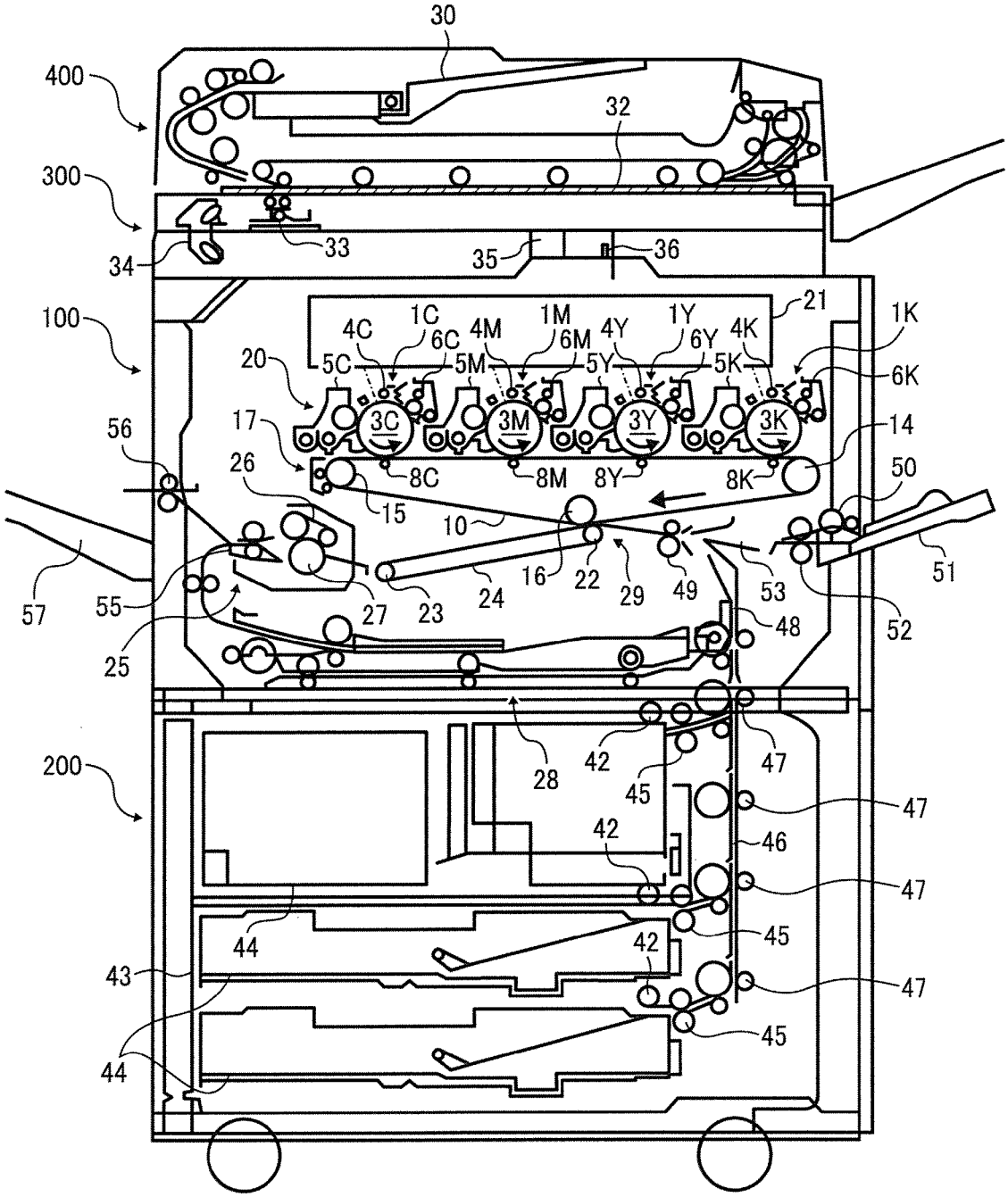
FIG. 2 schematically illustrates an image forming apparatus according to an illustrative embodiment of the present invention.

Referring now to the drawings, wherein like reference numerals designate identical or corresponding parts throughout the several views thereof, and particularly to FIG. 2, a tandem color image forming apparatus according to an illustrative embodiment of the present invention is described.

Referring to FIG. 2, the image forming apparatus includes a printer unit 100, a sheet feeder 200 used as a table on which the printer unit 100 is mounted, a scanner 300 provided over the printer unit 100, an automatic document feeder (ADF) 400 provided over the scanner 300, and a controller that controls respective parts of the image forming apparatus.

The image forming apparatus in the present embodiment is a tandem type electronographic copier employing an intermediate transfer (indirect transfer) method. The printer unit 100 includes an intermediate transfer belt 10 located in a center portion thereof and image forming units 1K, 1Y, 1M, and 1C, located above the intermediate transfer belt 10, that include drum-shaped photoreceptors 3K, 3Y, 3M, and 3C serving as image carriers. The intermediate transfer belt 10 is looped around support rollers 14, 15, and 16, and can rotate clockwise in FIG. 2. The photoreceptors 3K, 3Y, 3M, and 3C face the intermediate transfer belt 10, and black, yellow, magenta, and cyan images are formed thereon, respectively.

It is to be noted that the reference characters K, Y, M, and C represent black, yellow, magenta, and cyan, respectively, and may be omitted in the description below when color discrimination is not necessary.

In each image forming unit 1, a charger 4 for charging a surface of the photoreceptor 3 uniformly, a developing unit 5 for developing an electrostatic latent image formed on the photoreceptor 3 into a toner image, and a cleaning device 6 for cleaning the surface of the photoreceptor after the toner image is transferred therefrom are provided around the photoreceptor 3. The four image forming units 1K, 1Y, 1M, and 1C are arranged in parallel and form a tandem unit 20.

The printer unit 100 further includes primary transfer rollers 8K, 8Y, 8M, and 8C, a belt cleaner 17 disposed facing the support roller 16 via the intermediate transfer belt 10, and an exposure unit 21 located above the tandem unit 20.

Each primary transfer roller 8 presses against the corresponding photoreceptor 3 via the intermediate transfer belt 10, forming a primary transfer nip, where the toner image is transferred from the photoreceptor 3 onto the intermediate transfer belt 10.

The belt cleaner 17 cleans the intermediate transfer belt 10 after the toner image is transferred therefrom onto a sheet of recording media, such as paper, overhead projector (OHP) films, etc.

The printer unit 100 further includes a secondary transfer unit 29 located opposite the tandem unit 20 with respect to the intermediate transfer belt 10, a fixer 25 located on the left of the secondary transfer unit 29 in FIG. 2, a sheet reverse unit 28, and a switch claw 55.

The secondary transfer unit 29 includes a secondary transfer roller 22, a roller 23, and a secondary transfer belt 24 looped around these rollers. The secondary transfer roller 22 presses against the support roller 16 via the intermediate transfer belt 10 and the secondary transfer belt 24, forming a secondary transfer nip between the intermediate transfer belt 10 and the secondary transfer belt 24. After the toner image is transferred from the intermediate transfer belt 10 onto the sheet, the secondary transfer unit 29 transports the sheet to the fixer 25.

The fixer 25 includes an endless fixing belt 26 and a pressure roller 27 pressing against the fixing belt 26. The sheet reverse unit 29 is located beneath the secondary transfer unit 29 and the fixer 25 in parallel to the tandem unit 20.

The switch claw 55 switches a sheet transport route to a route leading to the sheet reverse unit 29 after an image is formed on a first side of the sheet. Then, the sheet reverse unit 29 reverses the sheet so that the sheet is again sent to the secondary transfer nip. Thus, images can be formed on both sides of the sheet, and then the sheet is discharged onto a discharge tray 57 provided on the left of the printer unit 100 in FIG. 2.

The printer unit 100 further includes a pair of registration rollers 49, a feed roller 50, a manual feed tray 51, a separation roller 52, and a pair of discharge rollers 56.

The scanner 300 includes a contact glass 32 on which an original document is set, a first carriage 33, a second carriage 34, an imaging lens 35, and a reading sensor 36 that reads image information of the original document and then transmits the image information to the controller. The ADF 400 includes a document table 30 on which the original document is set.

The controller causes a light source, such as a laser unit, a laser emitting diode (LED), etc., of the exposure unit 22 to emit an optical beam according to the image information, and then the optical beam is deflected and directed onto the surface of the photoreceptor 3. Thus, an electrostatic latent image is formed on the surface of the photoreceptor 3.

The sheet feeder 200 includes a paper bank 43 in which multiple sheet cassettes 44 containing multiple sheets are vertically arranged and multiple transport rollers 47. Each sheet cassette 44 is provided with a feed roller 42 that feeds the sheets from the sheet cassette 44 and a separation roller 45 that forwards the sheets one by one to a sheet feed path 46. The transport rollers 47 transport the sheet to a feed path 48 in the printer unit 100.

A multicolor copying operation using the image forming apparatus according to the present embodiment is described below.

First, a user sets the original document on the document table 30 of the ADF 400. Alternatively, the user lifts the ADF 400, sets the original document on the contact glass 32 of the scanner 300, and then lowers the ADF 400 so as to hold the original document with the ADF 400.

When the user presses a start button, the original document sets in the ADF 400 is forwarded onto the contact glass 32, and then the scanner 300 drives the first carriage 33 and the second carriage 34. By contrast, when the original document is sets on the contact glass 32, the scanner 300 immediately drives the first carriage 33 and the second carriage 34.

Subsequently, the first carriage 33 directs an optical beam from a light source onto the original document, and then the optical beam is reflected on a surface of the original document to the second carriage 34. Further, reflected by a mirror of the second carriage 34, the optical beam passes through the imaging lens 35 and then enters the reading sensor 36, and thus the reading sensor 36 obtains the image information of the original document.

In the printer unit 100, while the photoreceptor 3 rotates on a rotary shaft, each charger 4 uniformly charges the surface of the photoreceptor 3. The image information obtained by the scanner 300 is decomposed into black, yellow, magenta, and cyan single-color image information, and the exposure unit 21 directs laser beams onto the surfaces of the photoreceptors 3 according to the single-color image information, respectively.

Thus, electrostatic latent images are formed on the surfaces of the photoreceptors 3K, 3Y, 3M, and 3C, and then developed by the developing units 5K, 5Y, 5M, and 5C, forming black, yellow, magenta, and cyan single-color toner images thereon, respectively.

In parallel to the image forming operation described above, a driving motor rotates one of the support rollers 14 through 16, causing other two support rollers and the intermediate transfer belt 10 to be rotated. As the intermediate transfer belt 10 rotates, the single-color toner images are sequentially transferred from the photoreceptors 3K, 3Y, 3M, and 3C and superimposed one on another on the intermediate transfer belt 10, forming a multicolor toner image.

While the multicolor toner image is thus formed, in the sheet feeder 200, one of the feed rollers 42 is selectively driven so that sheets whose size corresponds to the image information is fed from the corresponding sheet cassette 44. Then, the sheets are forwarded by the separation roller 45 one by one to the sheet feed path 46 and further transported by the transport rollers 47 to the feed path 48 in the printer unit 100.

Alternatively, the feed roller 50 feeds the sheets on the manual feed tray 51, and then the separation roller 52 forwards the sheets one by one to a manual feed path 53.

Subsequently, the registration rollers 49 stop the sheet by sandwiching its leading edge portion therebetween and then rotate to send the sheet to the secondary transfer nip formed between the intermediate transfer belt 10 and the secondary transfer roller 22 in synchronization with movement of the multicolor toner image formed on the intermediate transfer belt 10. In the secondary transfer nip, the multicolor toner image is transferred from the intermediate transfer belt 10 onto the sheet due to a transfer electrical field and contact pressure between the intermediate transfer belt 10 and the secondary transfer belt 24.

After the toner image is thus recorded on the sheet, the secondary transfer belt 24 transports the sheet to the fixer 25, where the toner image is fixed thereon with heat and the pressure between the pressure roller 27 and the fixing belt 26. Then, the pair of discharge rollers 56 discharges the sheet onto the discharge tray 57.

In duplex printing, after the toner image is fixed on the first side of the sheet, the switch claw 55 guides the sheet to the sheet reverse unit 29, where the sheet is reversed and then forwarded again to the secondary transfer nip. Subsequently, another image is formed on a second side of the sheet, and then the sheet is discharged onto the discharge tray 57.

After the toner image is transferred onto the sheet in the secondary transfer nip, the belt cleaner 17 removes any toner remaining on the intermediate transfer belt 10 as preparation for subsequent image formation by the tandem unit 20.

It is to be noted that the image forming units 1K, 1Y, 1M, and 1C have an identical or similar configuration except the color of the toner used therein.

Figure 3:
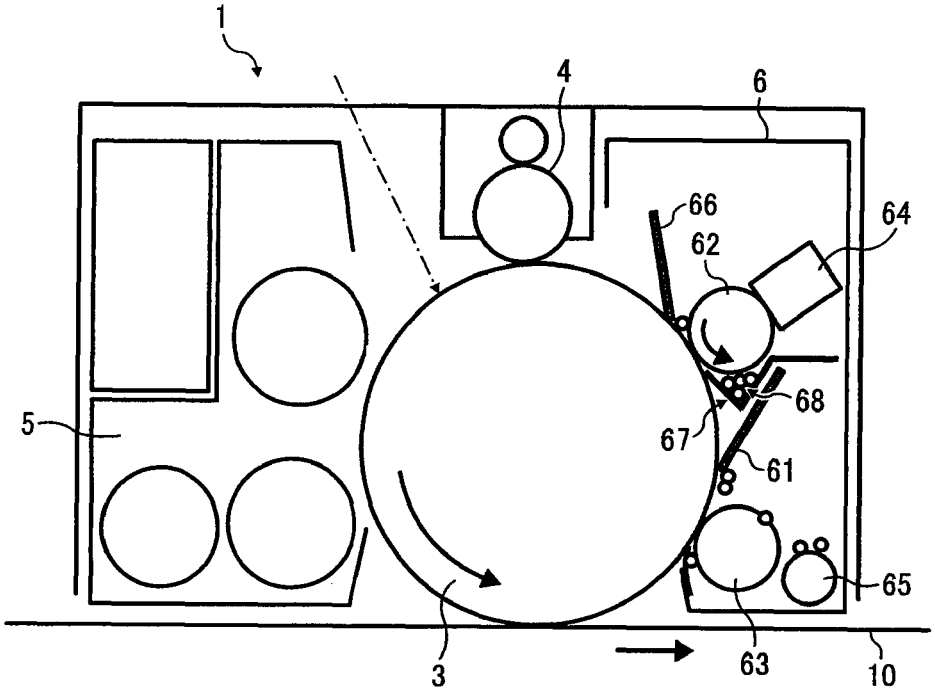
FIG. 3 is an end-on cross-sectional view schematically illustrating an image forming unit according to an illustrative embodiment.

FIG. 3 schematically illustrates a configuration of the image forming unit 1.

As shown in FIG. 3, a housing of the image forming unit 1 holds the photoreceptor 3, the charger 4, the developing unit 5, the cleaning device 6, etc., as a single unit, and thus the image forming unit 1 serves as a process cartridge insertable in and removable from the image forming apparatus shown in FIG. 2.

It is to be noted that, although the image forming unit 1 as the process cartridge is replaced as a whole in the present embodiment, alternatively, each of the charge 4, the developing unit 5, and cleaning device 6 can be configured to be replaceable independently.

The cleaning device 6 is described in further detail below.

Referring to FIG. 3, the cleaning device 6 includes a solid lubricant member 64 that in the present embodiment is solidified lubricant, such as zinc stearate, and a lubricating brush 62 serving as a lubricant applicator that applies the lubricant onto the surface of the photoreceptor 3.

In the cleaning device 6, a fur brush 63, a cleaning blade 61, the lubricating brush 62, and a doctor blade 66 are arranged in that order in a direction in which the surface of the photoreceptor 3 rotates (hereinafter "photoreceptor rotational direction" or "surface rotation direction of the image carrier"). In the present embodiment, the cleaning blade 61 and the doctor blade 66 are formed with an elastic material such as rubber. The cleaning device 6 further includes a transport screw 65 disposed on the right of the fur brush in FIG. 3, a catcher 67 serving as an accumulation preventer, and a storage portion 68.

The fur brush 63 rubs the toner remaining on the surface of the photoreceptor 3 so as to help the cleaning blade 61 to remove the toner therefrom. The cleaning device 6 further includes a flicking member, not shown, that flicks off the toner adhering to the fur brush 63. The transport screw 65 serves as a toner discharging member that collects the toner removed by the flicking member and the cleaning blade 61 and then discharges them outside the cleaning device 6. The cleaning blade 61 and the fur brush 63 together serve as a cleaning unit for cleaning the surface of the photoreceptor 3.

The lubricant member 64 is held by a bracket, and a pressure spring, not shown, presses the lubricant member 64 against the lubricating brush 62. The lubricating brush 62 rotates in a direction counter to the photoreceptor rotational direction while contacting both the lubricant member 64 and the photoreceptor 3. Thus, the lubricant is scraped from the lubricant member 64 and then applied onto the photoreceptor 3 while the lubricating brush 62 rotates.

The cleaning blade 61 is rotatably held by a blade holder and contacts the photoreceptor 3 in a direction counter to the photoreceptor rotational direction.

In the cleaning device 6 described above, after the toner remaining on the photoreceptor 3 is rubbed by the fur brush 63 and then removed by the cleaning blade 61, the lubricating brush 62 applies the lubricant onto the surface of the photoreceptor 3 from which the toner is removed. Then, the doctor blade 66 contacting the photoreceptor 3 in the counter direction distributes the lubricant uniformly over the entire surface of the photoreceptor 3.

Features of the present embodiment are described below.

Figure 4:
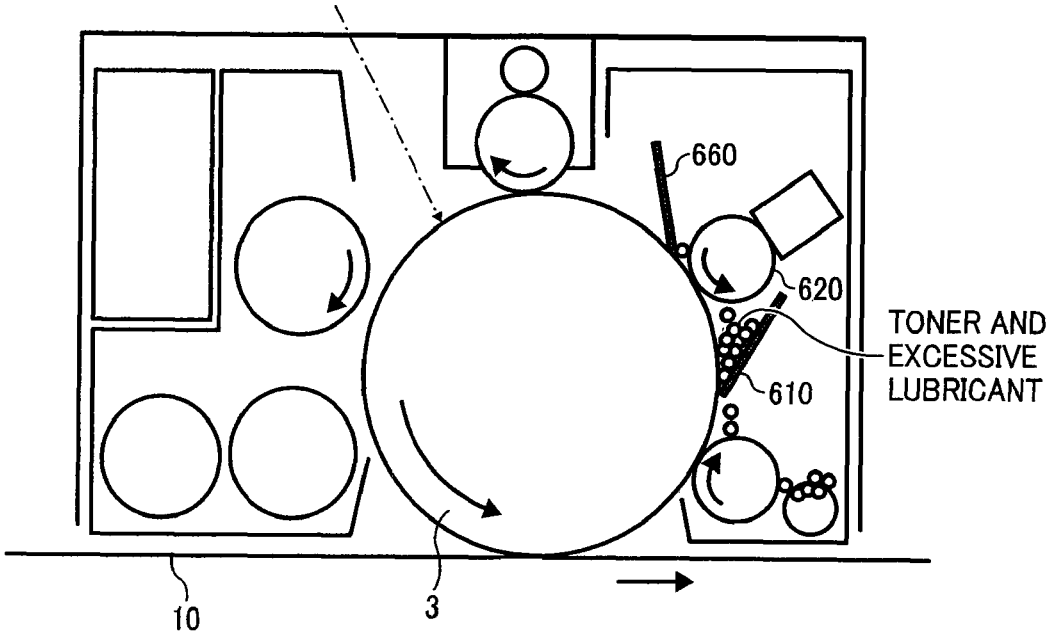
FIG. 4 is an end-on cross-sectional view schematically illustrating toner and excessive lubricant accumulated on a cleaning blade in a comparative cleaning device.

FIG. 4 illustrates a cleaning device according to a comparative example (hereinafter "comparative cleaning device") that includes a lubricating brush 620 and a doctor blade 660 both disposed above a cleaning blade 610 similarly to the cleaning device 6 shown in FIG. 3.

In the comparative cleaning device shown in FIG. 4, some toner can slip through a gap between the cleaning blade 610 and a photoreceptor 3 and reach the lubricating brush 620 or the doctor blade 660. Such toner is then scraped off or retained by the lubricating brush 620 or the doctor blade 660.

The lubricant brush 620 scrapes a solid lubricant to lubricate the photoreceptor 3, and some of the scraped lubricant can remains on the lubricating brush 620, that is, is not applied to the photoreceptor 3. Further, when the amount of lubricant on the photoreceptor 3 is excessive, the doctor blade 660 retains the excessive lubricant. The toner and the excessive lubricant retained by the doctor blade 660 can drop therefrom as the amount thereof increases and accumulate on the lubricating brush 620 when the doctor blade 660 is located above the lubricating brush 620 as shown in FIG. 4.

Further still, the toner and the excessive lubricant accumulated on the lubricating brush 620 can drop therefrom and accumulate on the cleaning blade 610. If such toner and excessive lubricant accumulate on the cleaning blade 610 over time, the accumulation will contact the photoreceptor 3 constantly, causing filming of the photoreceptor 3 and damage thereto. Further, some of the toner might again adhere to the surface of the photoreceptor 3 (hereinafter "reattaching of the toner"). If the doctor blade 660 constantly contacts the reattaching toner, its life can be shortened and the doctor blade 660 can fail to retain the reattaching toner, causing image failure. Moreover, if a significant amount of toner accumulates on the cleaning blade 610, the toner might scatter throughout the interior of the image forming apparatus, causing sensors used therein to malfunction.

In particular, in the configuration in which a tip portion of the cleaning blade 610 contacting the photoreceptor 3 is oriented down vertically, that is, the direction of the gravitational force, if the toner and the lubricant accumulate in significant amounts on the cleaning blade 610, the accumulation will fall under its own weight to a contact portion between the cleaning blade 610 and the photoreceptor 3. In such a case, the photoreceptor 3 can easily contact the accumulation.

Further, because the tip portion of the cleaning blade 610 and the surface of the photoreceptor 3 together form a wedge shape, the toner, the lubricant, and the like can be packed therein and accordingly contact the surface of the photoreceptor 3 relatively strongly.

In view of the foregoing, the cleaning device 6 according to the present embodiment includes the catcher 67 so as to prevent or reduce accumulation of the toner, the lubricant, and the like on the cleaning blade 61.

As shown in FIG. 3, the catcher 67 is disposed downstream from the cleaning blade 61 and upstream from the lubricating brush 62 in the photoreceptor rotational direction. The catcher 67 in the present embodiment is a sheet member that contacts the photoreceptor 3 in a direction trailing the rotation of the photoreceptor 3 or is disposed close thereto.

The catcher 67, located beneath the lubricating brush 62 and above the cleaning blade 61 as shown in FIG. 3, catches the toner and the excessive lubricant that drop from the lubricating brush 62 so as to prevent or reduce the accumulation thereof on the cleaning blade 61. The catcher 67 can be configured to guide the toner and the excessive lubricant drop from the lubricating brush 62 to the storage portion 68 or the screw 65.

It is to be noted that, when the catcher 67 contacts the photoreceptor 3, a urethane sheet, etc., that does not damage the photoreceptor 3 is preferred as a material for constructing the catcher 67.

The storage portion 68 can store the toner and the lubricant caught by the catcher 67. By providing a sufficiently large storage portion 68, the accumulation of the toner and the lubricant that drop from the lubrication brush 62 and the doctor blade 66 can be reliably retained therein until the process cartridge or the cleaning device 6 is replaced.

A variation of the present embodiment is described below with reference to FIG. 5.

Figure 5:
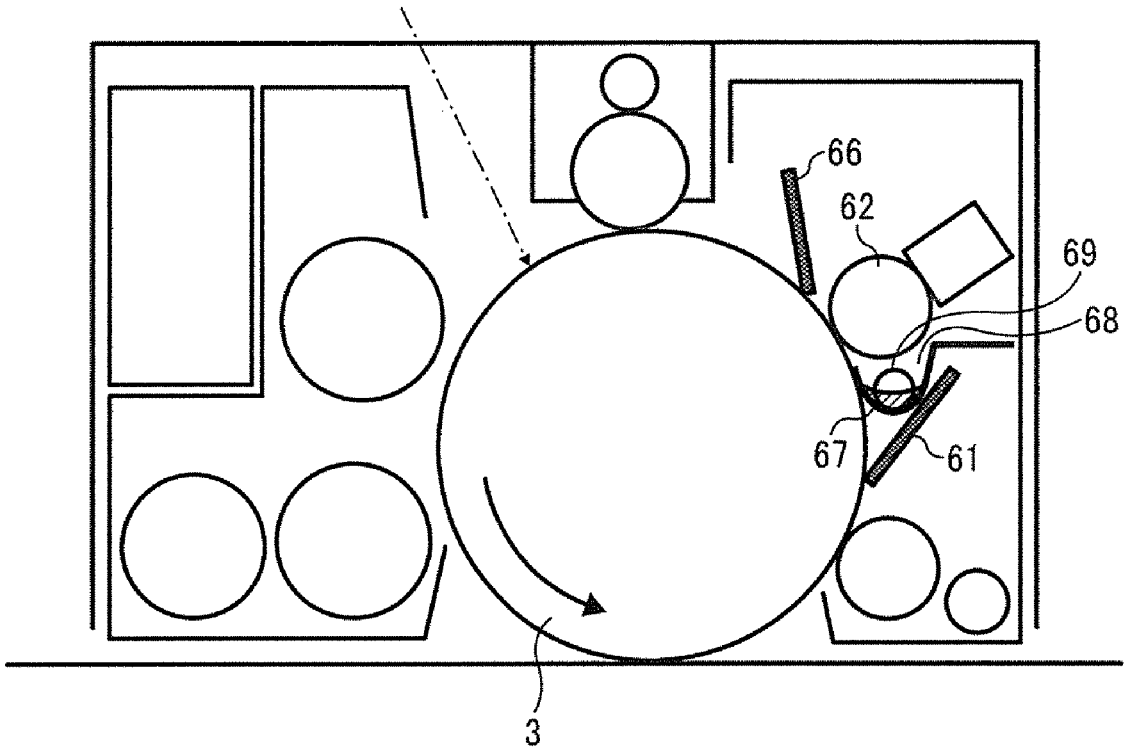
FIG. 5 is an end-on cross-sectional view schematically illustrating a variation of a cleaning device shown in FIG. 3.

In the variation shown in FIG. 5, the storage portion 68 can be provided with a screw 69 serving as a transport member that transports and discharges the toner and the lubricant. The screw 69 transports the toner and the excessive lubricant through a discharge path to a waste toner bottle, for example, located outside the cleaning device 6 similarly to the transport screw 65. The toner and the excessive lubricant transported from the storage portion 68 can be discharged through the discharge path through which the transport screw 65 discharges the toner removed by the cleaning blade 61.

Thus, because the toner and the lubricant that accumulate in the storage portion 68 do not increase excessively but can be discharged from the cleaning device 6, the accumulation of the toner and the lubricant on the cleaning blade 61 can be prevented or reduced reliably for a relatively long time period. Further, the scattering of the toner inside the image forming apparatus can be prevented or reduced.

Another variation of the present embodiment is described below with reference to FIG. 6.

Figure 6:
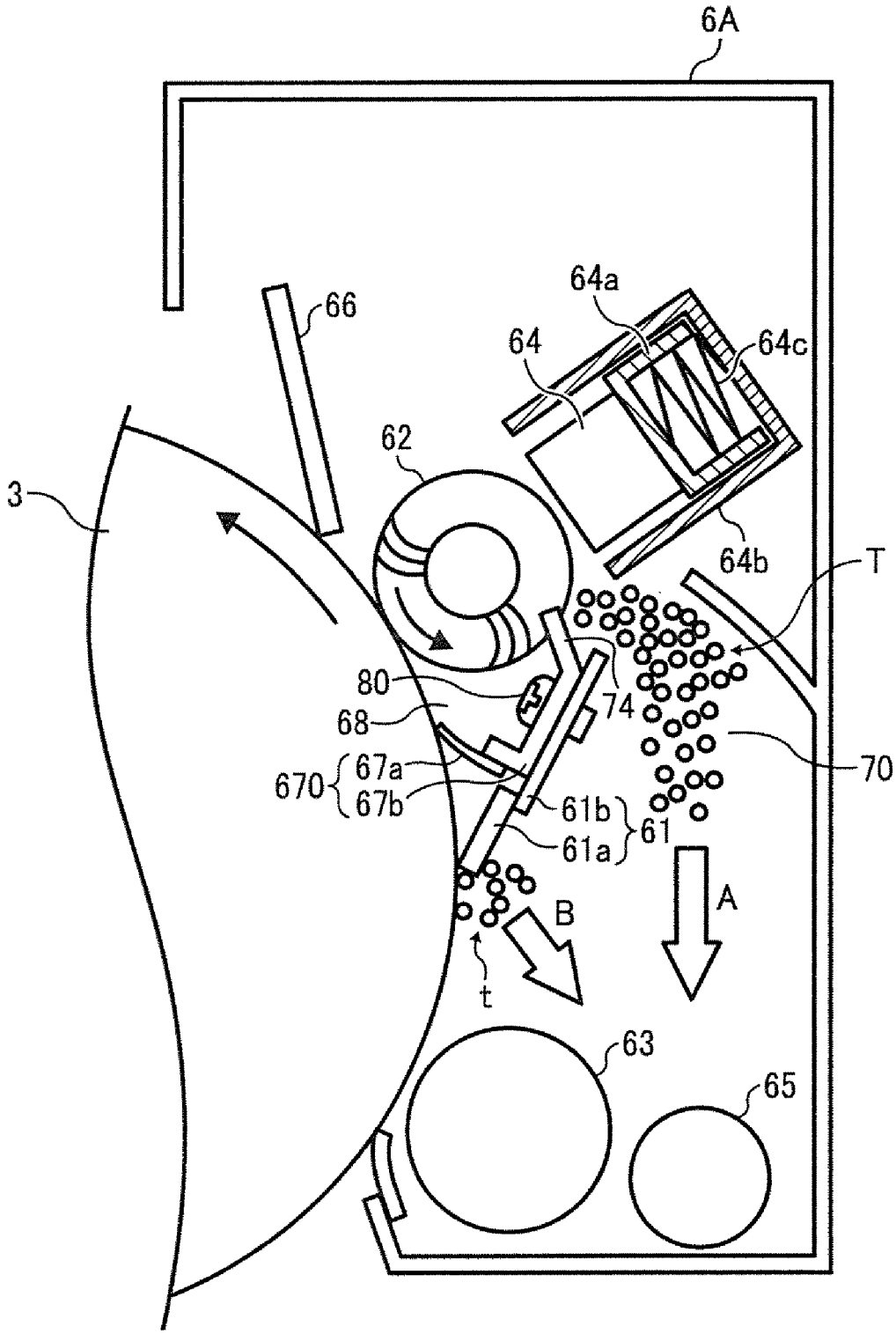
FIG. 6 is an enlarged view schematically illustrating another variation of the cleaning device shown in FIG. 3.

FIG. 6 is an enlarged view illustrating a cleaning device 6A according to another variation of the present embodiment.

The cleaning device 6A is provided with a cleaning blade 61, a lubricating brush 62, a lubricant member 64, a fur brush 63, a transport screw 65, a doctor blade 66, a catcher 670, and a storage portion 68.

The cleaning blade 61 includes a blade contact portion 61*a* that contacts the photoreceptor 3 and a blade holder 61*b*. The catcher 670 includes a contact portion 67*a* that contacts the photoreceptor 3 and a catcher holder 67*b*. The lubricant member 64 is held by a lubricant mount 64*a* serving as a lubricant holder and a lubricant guide 64*b*.

Further, the lubricating brush 62 is provided with a flicker 74 serving as a remover to remove a foreign substance T including the toner and the lubricant adhering thereto. The flicker 74 in the present variation is attached to the catcher holder 67*b*. When the flicker 74 is thus attached to the catcher 670, the number of components can be reduced. The lubricant mount 64*a* is biased by a spring 64*c* toward the lubricating brush 62.

It is to be noted that, in the present embodiment, the lubricating brush 62, the lubricant member 64, the lubricant mount 64*a*, the lubricant guide 64*b*, the spring 64*c*, and the flicker 74 serves as a lubricant applicator unit.

The flicker 74 is preferably formed with a metal plate, such as a galvanized plate, stainless steel plate, and so forth so as not to be shaved while rubbing the lubricating brush 62. Alternatively, when the flicker 74 is configured to be replaceable, the flicker 74 can be formed with a material such as resin, and is not limited to the metal plate. Additionally, the flicker 74 is preferably configured to contact the lubricating brush 74 in a forward direction with respect to the direction in which the lubricating brush 62 rotates so as not to hinder the rotation thereof.

In the configurations shown in FIGS. 3 and 5, in which the catcher 67 for preventing or reducing dropping of the foreign substance T (toner) on the cleaning blade 61 is provided as described above, the toner accumulated on the catcher 67 or in the storage portion 68 might again adhere to the lubricating brush 62, degrading lubricating performance of the lubricating brush 62. If the lubricating performance of the lubricating brush 62 is degraded, filming of the photoreceptor 3 and damage thereto can be caused. Further, in such a state, the toner can escape through the gap between the cleaning blade 61 and the photoreceptor 3, causing image failure, and the life of the lubricant member 64 and/or the doctor blade 66 can be shortened.

Therefore, as shown in FIG. 6, the cleaning device 6A according to the present variation includes the flicker 74 for removing the foreign substance T from the lubricating brush 62. Thus, even if the foreign substance T again adheres to the lubricating brush 62, the foreign substance T can be removed from the lubricating brush 62, minimizing the disadvantages described above.

The flicker 74 contacts the lubricating brush 62 so as to extend into a bristle area of the lubricating brush 62. Thus, as the lubricating brush 62 rotates, the foreign substance T is flicked off the lubricating brush 62 as shown in FIG. 6. The flicked foreign substance T is then transported through a discharge path 70 formed between the blade holder 61*b* and a casing of the cleaning device 6A and through a discharge path A to the transport screw 65. The discharge path 70 and the discharge path A together form a collection path.

The discharge path 70 is located downstream from a position where the flicker 74 contacts the lubricating brush 62 in the direction in which the lubricating brush 62 rotates and opposite the photoreceptor 3 with respect to the flicker 74 and the cleaning blade 61.

It is to be noted that the collection path is provided separately from a toner discharge path B, shown in FIG. 6, through which waste toner t removed by the cleaning blade 61 from the photoreceptor 3 moves to the transport screw 65.

The catcher holder 67*b* is fixed to the blade holder 61*b* with a screw 80. Thus, the cleaning blade 61 and the catcher 670 are integrated into a single unit. The lubricant member 64 is fixed to the lubricant mount 64*a* connected to the lubricant guide 64*b* via the spring 64*c* that is a biasing member formed with an elastic material. The lubricant guide 64*b* is fixed to a casing of the cleaning device 6A, and the spring 64*c* biases the lubricant mount 64*a* to the lubricating brush 62. As the solid lubricant member 64 is scraped by the lubricating brush 62 and thus becomes smaller, the spring 64*c* causes an outer surface of the lubricant mount 64*a* to slide on an inner surface of the lubricant guide 64*b*, bringing the lubricant member 64 close to the lubricating brush 62. That is, the lubricant guide 64*b* guides a direction in which the lubricant mount 64*a* moves, pushed by the spring 64*c*.

It is to be noted that a portion of the catcher 67 that contacts the photoreceptor 3 is formed with an elastic material so as not to damage the photoreceptor 3, and this elastic portion of the catcher 67 can deform over time. Therefore, by providing the catcher 670 integrally on the cleaning blade 61 as described above, a service time thereof can be synchronized, and thus the catcher 670 can be replaced before deteriorating significantly.

A shape of the lubricant guide 64*b* is described in further detail below with reference to FIGS. 7 and 8.

In the case of the variation shown in FIG. 6 including the flicker 74, if a length of the flicker 74 extending into the lubricating brush 62*a* or a depth of the lubricating brush 62*a* that the flicker 74 reaches, a direction in which the flicker 74 extends, etc., (hereinafter "extending state of the flicker 74") are improper, the foreign substance T flicked off the lubricating brush 62 might fly to the lubricant guide 64*b*, not to the transport screw 65 located upstream of the cleaning blade 61 in the photoreceptor rotational direction.

Figure 7:
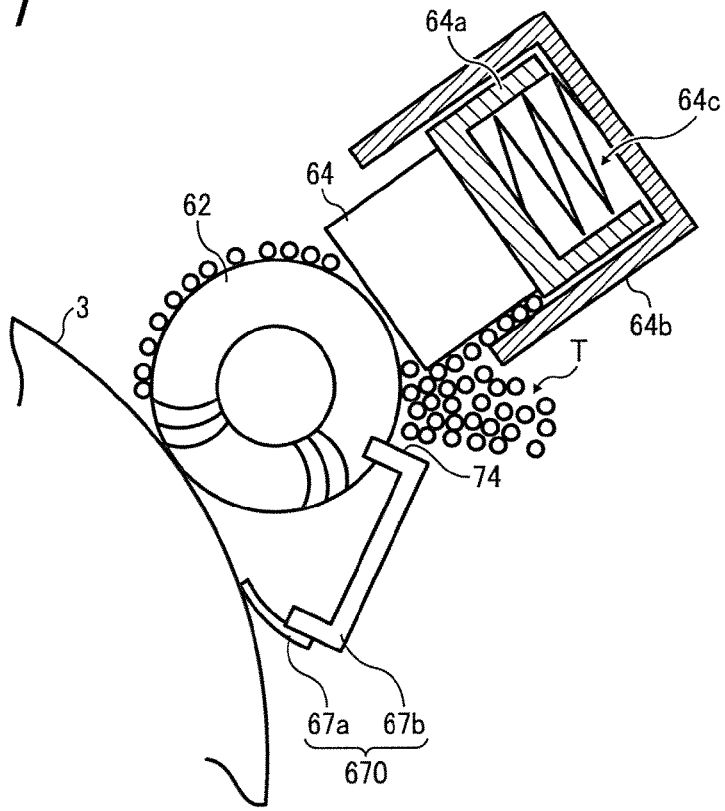
FIG. 7 is a schematic view illustrating the toner and the excessive lubricant adhered to an inner surface of a lubricant guide.

If the foreign substance T flies toward the lubricant guide 64*b* and then adheres to the inner surface of the lubricant guide 64*b* as shown in FIG. 7, sliding of the lubricant mount 64*a* thereon can be hindered, which prevents the lubricating brush 62 from scraping the lubricant member 64.

Figure 8:
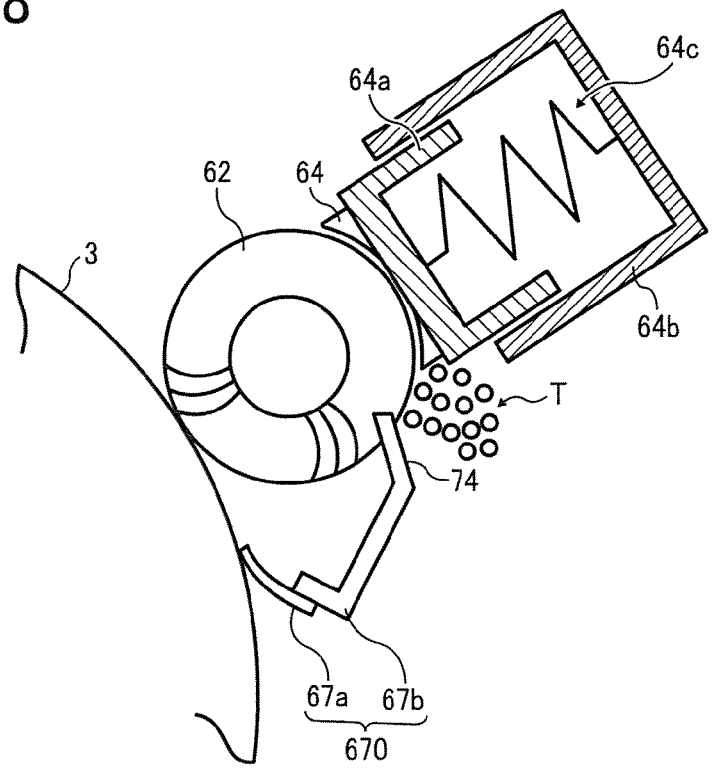
FIG. 8 is a schematic view illustrating a state in which a lubricant mount is close to a contact portion between a flapper and a lubricating brush.

Further, as the solid lubricant member 64 is consumed and becomes smaller over time, the lubricant mount 64*a* can approach a portion where the flicker 74 contacts the lubricating brush 62, as shown in FIG. 8, depending on the shape of the lubricant guide 64*b*.

If the lubricant mount 64*a* is close to the portion where the flicker 74 contacts the lubricating brush 62, it can hinder removal of the foreign substance T by the flicker 74 from the lubricating brush 62.

More specifically, the lubricant mount 64*a* has a cross-section larger than that of the lubricant member 64 because the lubricant mount 64*a* guides the lubricant member 64 along the inner surface of the lubricant guide 64*b*. In other words, an area of the lubricant mount 64*a* is larger than an area where the lubricant member 64 contacts the lubricant mount 64*a*. Accordingly, as the lubricant member 64 becomes smaller over time, an edge portion of the lubricant mount 64*a* approaches the flicker 74. In this state, some of the foreign substance T flicked off the lubricating brush 62 might bounce off the edge portion of the lubricant mount 64*a* and then again adhere to the lubricating brush 62, thus hindering the removal of the foreign substance T from the lubricating brush 62.

In view of the foregoing, a lubricant applicator unit according to another variation is described below with reference to FIGS. 9A and 9B.

Figure 9A:
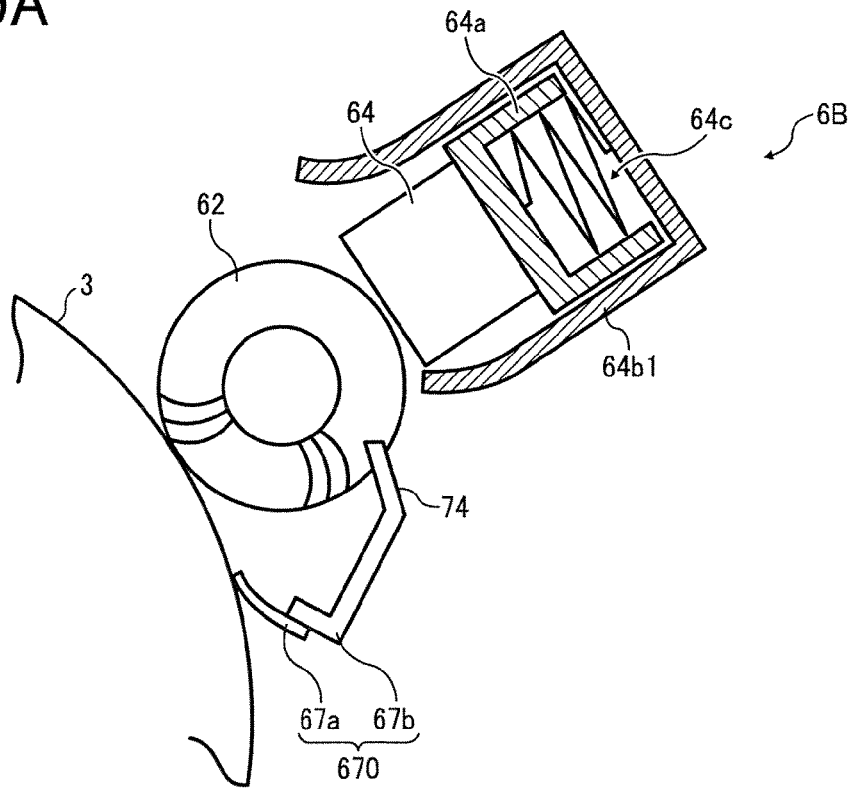
FIG. 9A is schematic view illustrating another variation of the cleaning device shown in FIG. 3, in which a lubricant member is barely used.
Figure 9B:
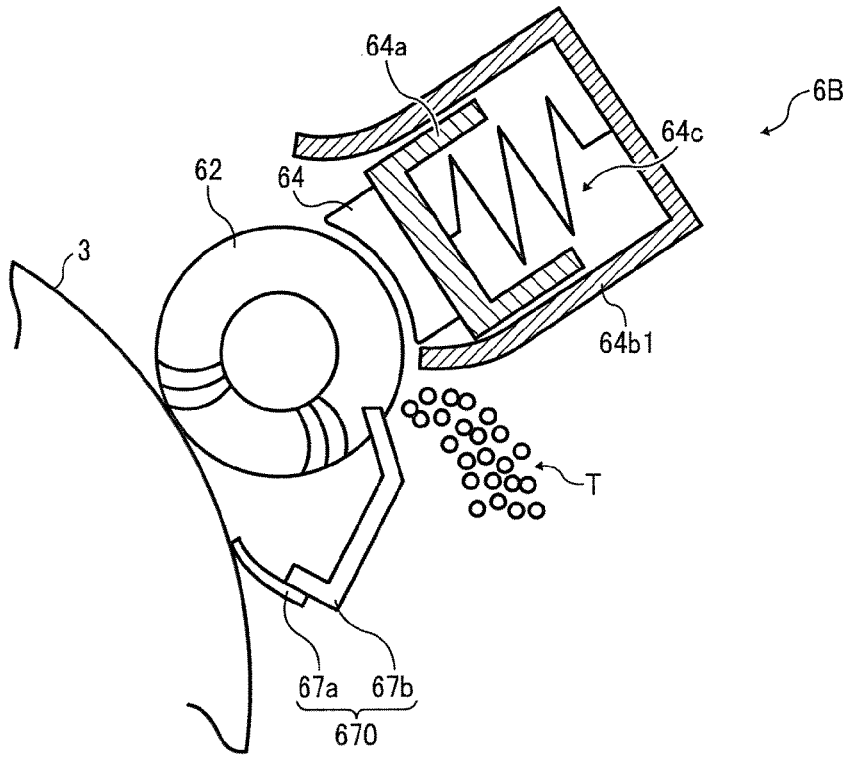
FIG. 9B is schematic view illustrating the cleaning device shown in FIG. 9A, in which only a small portion of lubricant member 64 is left.

FIGS. 9A and 9B schematically illustrates a main part of a cleaning device 6B.

It is to be noted that components of the cleaning device 6B except the lubricant applicator unit have a configuration identical or similar to those of the cleaning device 6A shown in FIG. 6, and thus descriptions thereof are omitted. Although the toner and the excessive lubricant can be stored in a storage portion similarly to the cleaning device 6 or 6A, the storage portion is omitted in FIGS. 9A and 9B.

In FIG. 9A, a lubricant member 64 is barely used, whereas in FIG. 9B, only a small portion of lubricant member 64 is left. In the cleaning device 6B, the lubricant member 64 is mounted on a lubricant mount 64*a* and guided to a lubricating brush 62 by a lubricant guide 64*b*1 similarly to the cleaning device 6A shown in FIG. 6. However, the lubricant guide 64*b*1 is configured to guide the lubricant member 64 away from a flicker 74 as the lubricant member 64 is consumed over time as shown in FIG. 9B.

When the lubricant guide 641*b* has the configuration shown in FIGS. 9A and 9B, even when the lubricant member 64 is consumed and becomes smaller over time, the lubricant mount 64*a* and the lubricant guide 64*b*1 do not hinder the removal of the foreign substance T from the lubricating brush 62. Further, such a configuration can prevent or reduce adherence of the foreign substance T (toner) flicked off the lubricating brush 62 by the flicker 74 to an inner surface of the lubricant guide 64*b*1. Consequently, reliable lubrication can be secured.

Another variation is described below with reference to FIGS. 10A and 10B.

Figure 10A:
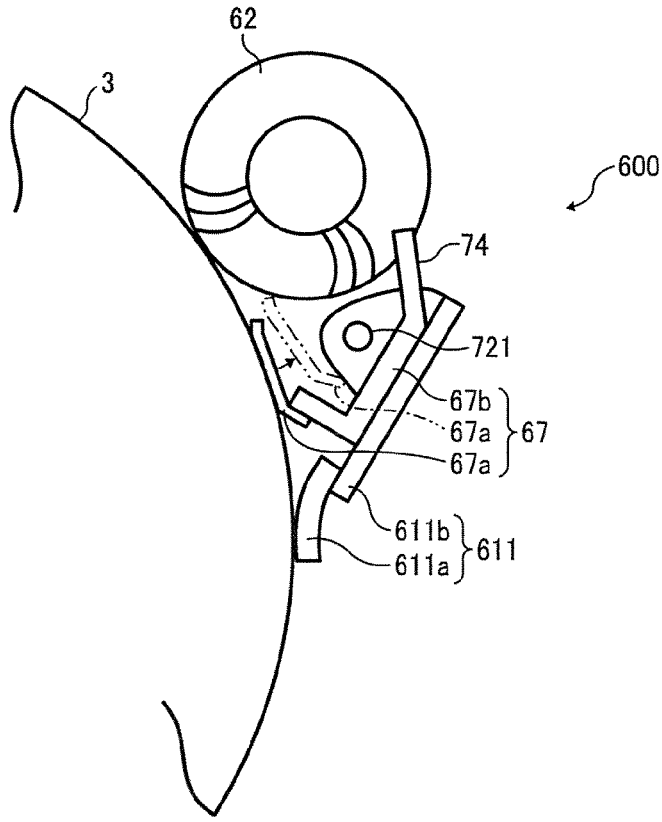
FIG. 10A illustrates a state of a cleaning blade of a comparative cleaning device under a high-temperature and high-humidity condition.

FIG. 10A illustrates a main part of a cleaning device 600 according to a comparative example under conditions of relatively high temperature and relatively high humidity. It is to be noted that, other than a cleaning blade 611, the comparative cleaning device 600 has a configuration similar to that of the cleaning device 6A shown in FIG. 6, and thus a description thereof is omitted.

Referring to FIG. 10A, a space between the cleaning blade 611, that is, a blade contact portion 611*a* thereof, and the photoreceptor 3 is generally relatively small, and the space will be reduced as curvature and deformation of the cleaning blade 611 change over time and depending on environmental conditions.

In the comparative cleaning device 600, when the cleaning blade 611 is repeatedly used under such high-temperature and high-humidity conditions, the blade contact portion 611*a* thereof can deform or curve significantly, causing a blade holder 611*b* to pivot clockwise about a support shaft 721. When the blade holder 611*b* thus pivots clockwise, the space between the blade contact portion 611*a* and a photoreceptor 3 is reduced, and accordingly, an edge portion of a bonded portion between a contact portion 67*a* of a catcher 67 and a catcher holder 67*b* can contact the photoreceptor 3. If the bonded portion contacts the photoreceptor 3, a frictional force between the bonded portion and the photoreceptor 3 will pull the contact portion 67*a* downstream in the photoreceptor rotational direction to an extent that the contact portion 67*a* disengages from the catcher holder 67*b*, as indicated by a dotted-line shown in FIG. 10A.

Figure 10B:
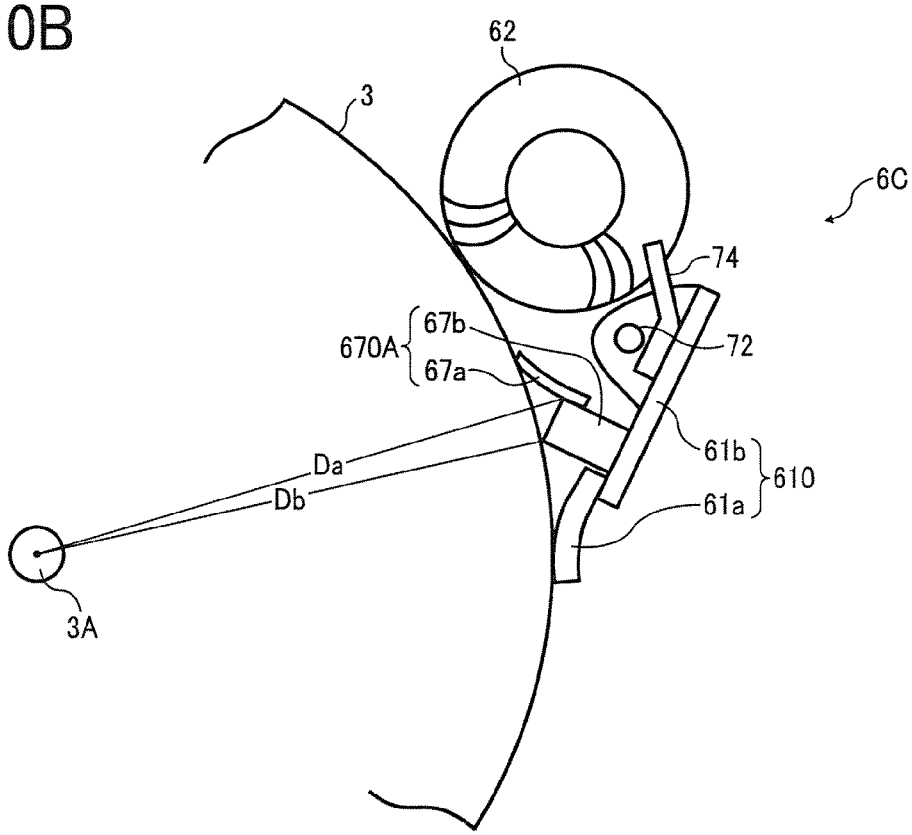
FIG. 10B is schematic view illustrating another variation of the cleaning device shown in FIG. 3.

By contrast, a cleaning device 6C according to the present variation is shown in FIG. 10B.

FIG. 10B illustrates a main part of the cleaning device 6C. It is to be noted that, except for a catcher 670A, the cleaning device 6C has a configuration similar to that of the cleaning device 6A shown in FIG. 6, and thus a description thereof is omitted.

Referring to FIG. 10B, a catcher 670A includes a contact portion 67*a* and a catcher holder 67*b* bonded to a blade holder 61*b* that is pivotable about a support shaft 72. The photoreceptor 3 is rotatably supported by a rotary shaft 3A. The catcher holder 67*b* in the present variation is formed with an elastic material identical or similar to the material of the blade contact portion 61*a* of the blade 61. Further, a distance Da between the rotary shaft 3A and an edge portion of a bonded portion between the contact portion 67*a* and the catcher holder 67*b* is longer than a distance Db between the rotary shaft 3A and a portion of the catcher holder 67*b* closest to the photoreceptor 3.

In the configuration described above, the catcher supporter 67*b* can contact the photoreceptor 3 earlier than the contact portion 67*a* of the catcher 670 does, thus preventing the contact portion 67*a* from disengaging from the catcher holder 67*b*. Further, as the catcher holder 67*b* is elastic, the surface of the photoreceptor 3 is not damaged.

Now, a process cartridge integrally including the cleaning device 6A shown in FIG. 6 and the photoreceptor 3 is described below with reference to FIG. 11.

Figure 11:
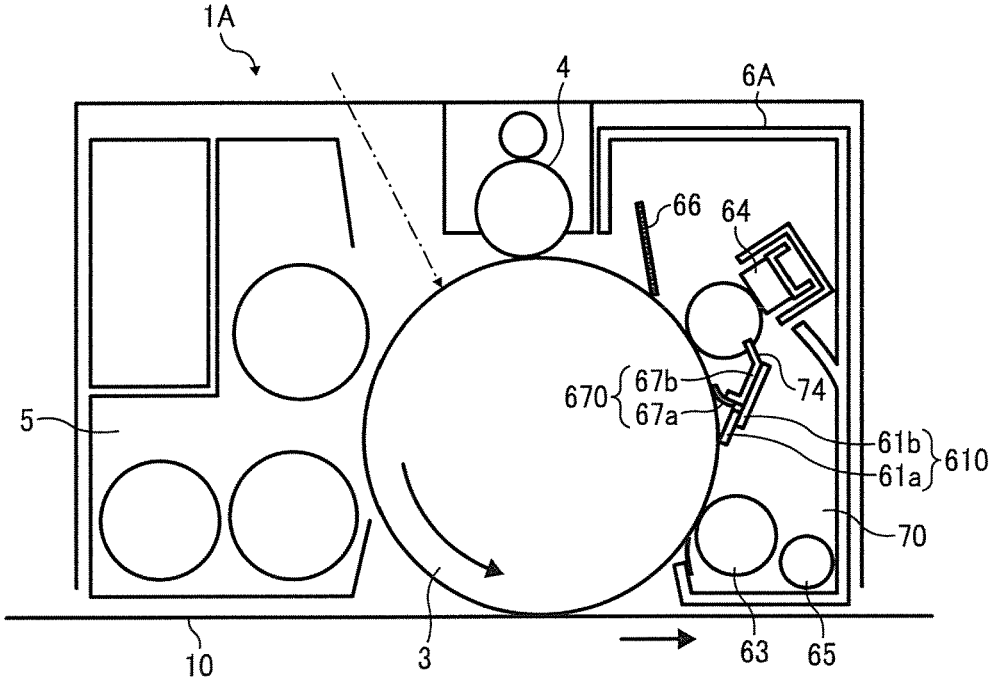
FIG. 11 is an end-on cross-sectional view illustrating a process cartridge including the cleaning device shown in FIG. 6.

FIG. 11 illustrates a process cartridge 1A that is removably insertable in the printer unit 100 shown in FIG. 3.

When the photoreceptor 3 and the cleaning device 6A including the flicker 74 and the collection path (paths 70 and A) described with reference to FIG. 6 are held in a common unit casing, that is, are integrated into the process cartridge 1A as a single unit, replacement periods of the photoreceptor 3 and the components of the cleaning device 6A can be synchronized.

Because the cleaning device 6A shown in FIG. 6 includes the flicker 74, the foreign substance T adhered to the lubricating brush 62 can be removed so as to eliminate or reduce the causes of shortening the lives of the lubricating brush 62, the lubricating member 64, the doctor blade 66, etc., and thus the lives thereof can be extended.

It is to be noted that, although its life is relatively long, when the cleaning device 6A reaches the end of its life, the process cartridge 1A is removed from the printer unit 100 for replacement of the cleaning device 6A. Further, when cleaning device 6A reaches the end of its life, performance of the components of the cleaning device 6A is reduced, deteriorating the photoreceptor 3. Accordingly, it is preferable to replace the cleaning device 6A and the photoreceptor 3 simultaneously.

If the cleaning device 6A and the photoreceptor 3 are configured to be independently removed from the printer unit 100, the removal work is relatively complicated and includes an additional operation to align the components of the cleaning device 6A that contact the photoreceptor 3 with respect to the photoreceptor 3. Additionally, the user might forget to replace one of the cleaning device 6A and the photoreceptor 3 while both should be replaced simultaneously. In such a case, because one of them is not replaced, an expected improvement in performance cannot be attained.

The inconveniences described above can be eliminated by integrating the cleaning device 6A and the photoreceptor 3 into the process cartridge 1A that is removably insertable in the printer unit 100.

Another embodiment is described below with reference to FIGS. 12 and 13.

Figure 12:
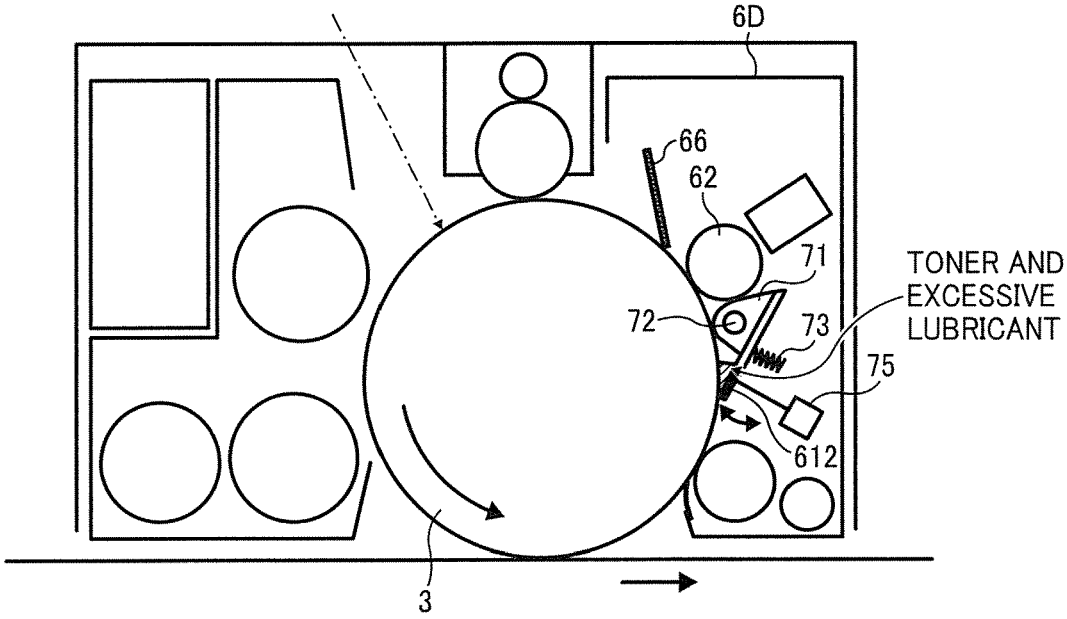
FIG. 12 is an end-on cross-sectional view illustrating a cleaning device according to another embodiment, in which a cleaning blade engages a photoreceptor.
Figure 13:
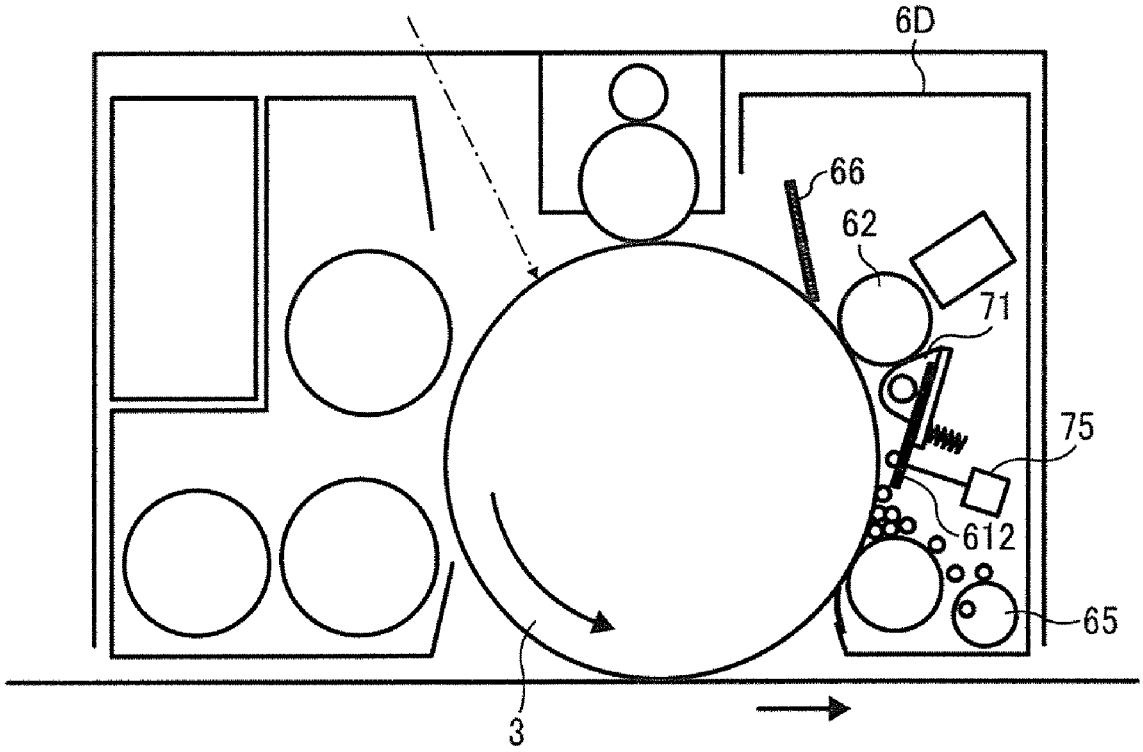
FIG. 13 is an end-on cross-sectional view illustrating the cleaning device shown in FIG. 12, in which the cleaning blade is disengaged from the photoreceptor.

FIGS. 12 and 13 illustrate a cleaning device 6D according to another embodiment of the present invention.

As shown in FIG. 12, the cleaning device 6D includes a cleaning blade 612 held by a holder 71 that is pivotable about a shaft 72, a pressure member 73 pressing the cleaning blade 612 against a photoreceptor 3, a lubricating brush 62, and a doctor blade 66. The cleaning device 6D and at least the photoreceptor 3 are held in a process cartridge removably insertable in the printer unit 100 shown in FIG. 3.

Differently from the cleaning devices 6A, 6B, and 6C respectively shown in FIGS. 6, 9A, and 10B, the cleaning device 6D does not include a catcher that catches the toner and the excessive lubricant that drop from the lubricating brush 62.

Instead, the cleaning device 6D includes an engaging and disengaging member 75 that in the present embodiment is a solenoid connected to the holder 71. The engaging and disengaging member (hereinafter also "solenoid") 75 engages and disengages the cleaning blade 612 from the photoreceptor 3 so as to drop the toner and the excessive lubricant accumulated on the cleaning blade 612 (hereinafter "accumulation on the cleaning blade 612") inside the cleaning device 6D. Various known engaging and disengaging mechanisms using a solenoid, etc., can be used as the engaging and disengaging member 75.

It is to be noted that the cleaning device 6D has a configuration similar to that of the cleaning devices 6A shown in FIG. 6 except the description above, and thus a description thereof is omitted.

Cleaning of the cleaning blade 612 using the solenoid 75 (hereinafter also "disengagement operation of the engaging and disengaging member") is described below.

In FIG. 12, the cleaning blade 612 contacts the photoreceptor 3, and the toner and the excessive lubricant accumulate on the cleaning blade 612 in this state. From the state shown in FIG. 12, the cleaning blade 612 is disengaged from the photoreceptor 3 by turning on the solenoid 75 as shown in FIG. 13, and thus the accumulation on the cleaning blade 612 drops inside the cleaning device 6D. Then, a transport screw 65 located beneath the cleaning blade 612 transports the toner and the excessive lubricant outside the cleaning device 6D through a toner discharge path. After the cleaning blade 612 is thus disengaged from the photoreceptor 3, the solenoid 75 is turned off so as to again enable the cleaning blade 612 to contact the photoreceptor 3, and then the cleaning blade 612 cleans the surface of the photoreceptor.

As described above, because the configuration shown in FIGS. 12 and 13 does not require a storage portion for storing the toner and the excessive lubricant nor a collection path provided separately from the toner discharge path, the cleaning device 6D can be more compact than the configuration shown in FIG. 6.

Preferably, the cleaning blade 612 is disengaged from the photoreceptor 3 at least twice in the disengagement part of the operation of the engaging and disengaging member 75. While the cleaning blade 612 is disengaged from the photoreceptor 3 at least twice, movement of the cleaning blade 612, contact between the cleaning blade 612 and the photoreceptor 3, and deformation of the cleaning blade 612 cause vibration, and thus the accumulation on the cleaning blade 612 can be effectively removed.

It is to be noted that, when the amount of the accumulation on the cleaning blade 612 is relatively small, the disengagement operation is not required. The amount of the accumulation can be predicted based on the amount of the toner applied onto the photoreceptor 3, that is, the area of an image formed on the photoreceptor 3 (image area), the number of copies formed, and the like. Therefore, it is preferable to set an amount of the accumulation that requires the disengagement operation (hereinafter "predetermined accumulation amount") preliminarily and to perform the disengagement operation when the predicted accumulation amount reaches the predetermined accumulation amount.

Thus, timing when the engaging and disengaging member 75 performs the disengagement operation (hereinafter "timing of the disengagement operation) can be determined by toner consumption predicted by the image area and the number of copies formed. By setting the timing of the disengagement operation as described above, frequency of the disengagement operation can be reduced, and accordingly the solenoid 75 can have a relatively long life while downtime of the image forming apparatus (interruption time) due to the disengagement operation can be minimized.

Further, because the cleaning blade 612 causes changes in a load on the photoreceptor 3 by engaging and disengaging from the photoreceptor 3, image failure such as banding, in which light or dark lines in an image, and jitter, which means image wander, can be caused if the disengagement operation is performed during image formation. Moreover, it is inefficient if the toner is present on the photoreceptor 3 while the cleaning blade 612 is disengaged therefrom because he lubricating brush 62 and the doctor blade 66 will catch the toner, resulting in the accumulation on the cleaning blade 612. Therefore, it is preferable to perform the disengagement operation while the toner is not present on the photoreceptor 3.

In view of the foregoing, the disengagement operation is preferably performed while image formation is not performed so as to prevent or reduce such image failure. More preferably, the disengagement operation is performed during image adjustment or process control, start-up operation, etc., so as to reduce downtime.

Further, when the process cartridge is removed from the printer unit 100 shown in FIG. 3 to replace the cleaning device 6D, a new cleaning blade 612 is disengaged from the photoreceptor 3 in an initial state (hereinafter "initial disengagement"), and then, the toner is input to a new doctor blade 66. With this operation, the toner is input to a contact edge portion between the new doctor blade 66 and the photoreceptor 3, which can reduce the frictional coefficient between the doctor blade 66 and the photoreceptor 3.

If the initial disengagement is not performed, the frictional coefficient between the new doctor blade 66 and the photoreceptor 3 is relatively large, which can cause deformation of the doctor blade 66 in the photoreceptor rotational direction, lock-up of the photoreceptor 3 due to an increase in driving torque thereof, and so on. Although the photoreceptor can rotate at a relatively low torque when a sufficient amount of the lubricant is applied to the photoreceptor 3 and then is input to an edge portion of the cleaning blade 612, there is a time lag from the initial state until the sufficient amount of the lubricant is into to the edge portion of the cleaning blade 612. Therefore, the toner is input to the new doctor blade 66 in the initial disengagement to as to prevent those inconveniences.

As described above, in the embodiment described with reference to FIG. 3, the catcher 67 disposed downstream from the cleaning blade 61 and upstream from the lubricating brush 62 serves as the accumulation preventer that prevents the toner and the excessive lubricant dropped from the lubricating brush 62 from accumulating on the cleaning blade 61. Thus, the photoreceptor 3 can be prevented from constantly contracting the toner and the excessive lubricant accumulated on the cleaning blade 61. Further, the storage portion 68 is provided so as to store the toner and the excessive lubricant caught by the lubricating brush 62. Thus, the toner and the excessive lubricant do not overflow, maintaining effect of the catcher 67.

Further, in the configuration shown in FIG. 5, the storage portion 68 is provided with the transport member 69. Thus, the toner and the excessive lubricant stored in the storage portion 68 do not increase excessively but are discharged outside the cleaning device 6, the accumulation of the toner and the lubricant on the cleaning blade 61 can be prevented or reduced reliably for a relatively long time period.

Alternatively, the accumulation preventer can be the engaging and disengaging member (solenoid) 75 as in the embodiment described with reference to FIGS. 12 and 13. By disengaging the cleaning blade 612 from the photoreceptor 3 using the solenoid 75 at a proper timing, the toner and the excessive lubricant accumulated on the cleaning blade 612 can be removed. The configuration shown in FIGS. 12 and 13 can be more compact because the storage portion for storing the toner and the excessive lubricant and a separate collection path therefor are not necessary.

The toner and the excessive lubricant can be efficiently removed from the cleaning blade 612 by disengaging the cleaning blade 612 from the photoreceptor 3 at least twice in the cleaning of the cleaning blade 612. Further, frequency thereof can be reduced by setting the solenoid 75 to perform the disengagement operation at the timing determined by toner consumption predicted by the image area and the number of copies. Accordingly, the solenoid 75 can have a relatively long life while the downtime due to the disengagement operation can be reduced. Further, by setting the solenoid to perform the disengagement operation while image formation is not performed, image failure can be prevented.

Further, by integrating the cleaning device 6 and the photoreceptor 3 into a single process cartridge removably insertable in the image forming apparatus, replacement thereof can be simplified.

Moreover, the cleaning device 6A in FIG. 6 includes the flicker 74 that removes the toner and the excessive lubricant from the lubricating brush 62. Thus, even if the toner and the excessive lubricant accumulated in the storage portion 68 reattach the lubricating brush 62, the toner and the excessive lubricant can be removed therefrom, maintaining performance of the lubricating brush 62 reliably.

The cleaning device 6A in FIG. 6 further includes the collection path including the discharge path 70 and discharge path A through which the toner and the lubricant flicked off the lubricating brush 62 is transported to the transport screw 65 located upstream from the cleaning blade 61 in the photoreceptor rotational direction. Then, the toner and the lubricant transported through the collection path as well as the waste toner removed from the cleaning blade 61 can be discharged outside the cleaning device 6A through a common path.

Further, the discharge path 70 is located downstream from the position where the flicker 74 contacts the lubricating brush 62 in the direction in which the lubricating brush 62 rotates. Thus, using the force of the flicker 74 to remove the toner and the lubricant from the lubricating brush 62, the toner and the lubricant can be transported to the screw 65 located upstream from the cleaning blade 61 in the photoreceptor rotational direction.

Moreover, in the cleaning device 6B shown in FIGS. 9A and 9B, the lubricant member 64 is mounted on the lubricant mount 64*a*, and the lubricant guide 64*b*1 guides the lubricant mount 61*a* so that the contact portion between the lubricant member 64 and the lubricating brush 62 is not close to the contact portion between the flicker 74 and the lubricating brush 62 even if the lubricant member 64 is consumed and becomes smaller. Thus, performance of the lubricant applicator unit can be maintained.

Numerous additional modifications and variations are possible in light of the above teachings. It is therefore to be understood that, within the scope of the appended claims, the disclosure of this patent specification may be practiced otherwise than as specifically described herein.

What is claimed is:

1. A cleaning device for cleaning a surface of a rotatable image carrier, the cleaning device comprising:

a cleaning blade disposed to contact the image carrier and configured to remove toner on the surface of the image carrier;

a lubricant applicator unit disposed above the cleaning blade, downstream from the cleaning blade in a surface rotation direction of the image carrier and configured to apply lubricant onto the surface of the image carrier;

an accumulation preventer configured to prevent the toner and excessive lubricant from the lubricant applicator unit from accumulating on the cleaning blade, wherein the accumulation preventer is a catcher disposed downstream from the cleaning blade and upstream from the lubricant applicator unit in the surface rotation direction of the image carrier and configured to prevent the toner and the excessive lubricant from dropping onto the cleaning blade;

a storage portion in which the toner and the excessive lubricant dropped from the lubricant applicator unit is stored; and a transport member to discharge the toner and the excessive lubricant stored in the storage portion outside the cleaning device.

2. The cleaning device according to claim 1, incorporated into an image forming apparatus comprising the image carrier and a developing unit to develop an electrostatic latent image into a toner image.

3. A process cartridge configured to be removably insertable in an image forming apparatus and accommodate a rotatable image carrier and a cleaning device for cleaning a surface of the image carrier, the cleaning device comprising:

a cleaning blade disposed to contact the image carrier and configured to remove toner on the surface of the image carrier;

a lubricant applicator unit disposed above the cleaning blade, downstream from the cleaning blade in a surface rotation direction of the image carrier and configured to apply lubricant onto the surface of the image carrier;

an accumulation preventer configured to prevent accumulation of the toner and excessive lubricant on the cleaning blade, wherein the accumulation preventer is a catcher disposed downstream from the cleaning blade and upstream from the lubricant applicator unit in the surface rotation direction of the image carrier and configured to prevent the toner and the excessive lubricant from dropping onto the cleaning blade;

a storage portion in which the toner and the excessive lubricant dropped from the lubricant applicator unit is stored; and a transport member to discharge the toner and the excessive lubricant stored in the storage portion outside the cleaning device.

* * * * *